US005917281A

United States Patent [19]

Shimoi et al.

[11] Patent Number: 5,917,281

[45] Date of Patent: Jun. 29, 1999

[54] PHOTOMULTIPLIER TUBE WITH INVERTING DYNODE PLATE

[75] Inventors: Hideki Shimoi; Hiroyuki Kyushima, both of Hamamatsu, Japan

[73] Assignee: Hamamatsu Photonics K.K., Hamamatsu, Japan

[21] Appl. No.: 08/954,961

[22] Filed: Oct. 21, 1997

[51] Int. Cl.[6] ..... H01J 43/10; H01J 43/18

[52] U.S. Cl. ..... 313/533; 313/103 R; 313/104; 313/540

[58] Field of Search ..... 313/532, 533, 313/534, 537, 540, 103 R, 103 CM, 104, 105 R, 105 CM; 250/214 VT, 207

[56] References Cited

U.S. PATENT DOCUMENTS

| | | | |
|---|---|---|---|
| 5,180,943 | 1/1993 | Kyushima | 313/535 |
| 5,410,211 | 4/1995 | Kyushima | 313/103 R |
| 5,504,386 | 4/1996 | Kyushima et al. | 313/103 R |
| 5,572,089 | 11/1996 | Kyushima et al. | 313/533 |
| 5,619,100 | 4/1997 | Kyushima et al. | 313/533 |
| 5,637,959 | 6/1997 | Kyushima et al. | 313/533 |

FOREIGN PATENT DOCUMENTS

| | | | |
|---|---|---|---|
| 0 565 247 A1 | 10/1993 | European Pat. Off. | H01J 43/28 |
| 0 622 824 A1 | 11/1994 | European Pat. Off. | H01J 43/04 |
| 0-690478 | 1/1996 | European Pat. Off. | H01J 43/22 |
| A-6-314550 | 11/1994 | Japan | H01J 43/12 |

*Primary Examiner*—Sandra O'Shea
*Assistant Examiner*—Michael Day
*Attorney, Agent, or Firm*—Oliff & Berridge, PLC

[57] ABSTRACT

According to the photomultiplier tube, the dynode unit 10 is constructed from a plurality of stages of dynodes 11 laminated one on another for multiplying incident electrons in a cascade manner through each of a plurality of channels. The anode unit 13 has a plurality of anodes 24 which define a plurality of electron passage gaps 14 each for transmitting the electrons emitted from the dynode unit 10 at a corresponding channel. The inverting dynode plate 15 is provided with a plurality of electron incident strips 17 each for receiving electrons having passed through a corresponding electron passage gap 14 in the anode unit 13, multiplying the electrons, and guiding the electrons back to the corresponding anode 24. The electron incident strip 17 is designed to have: the main surface 18*a* confronting the electron passage gap 14; and the rising surface 18*c* rising toward the anode unit 13 from the edge 18*b* of the main surface 18*a* which is located at a position confronting the electron passage gap 14 in the anode unit 13.

16 Claims, 12 Drawing Sheets

PHOTOMULTIPLIER TUBE WITH INVERTING DYNODE PLATE

BACKGROUND OF THE INVENTION

1. Field of the Invention

The present invention relates to an electron multiplier and a photomultiplier tube each of which has an inverting dynode for inverting orbits of electrons which have passed through gaps provided in multi-anodes and for guiding the electrons back to the multi-anodes.

2. Description of Related Art

A multi-anode type photomultiplier tube provided with an inverting dynode has been proposed, for example, by Japanese Patent Unexamined Patent Application Publication (Kokai) No.6-314550.

FIG. 1 schematically shows a part of the multi-anode type photomultiplier tube of this publication. The photomultiplier tube includes a block-shaped dynode unit 100. The dynode unit 100 is constructed from a plurality of dynode plates which are stacked one on another. The plurality of dynode plates multiply electrons in a cascade manner. An anode unit 101 is located below the dynode unit 100. The anode unit 101 is constructed in a multi-anode structure. That is, the anode unit 101 includes a plurality of anodes 103, which are separated from one another by a plurality of electron passage gaps 102, through which electrons emitted from the dynode unit 100 pass.

An inverting dynode plate 104 is located below the anode unit 101. The inverting dynode plate 104 is formed with a plurality of electron incident portions 106. The electron incident portions 106 are provided in one-to-one correspondence with the anodes 103. That is, each electron incident portion 106 is located confronting an electron passage gap 102 that is positioned to the left of a corresponding anode 103. Each electron incident portion 106 has an upper flat surface 105 for receiving electrons which have passed through its confronting electron passage gap 102, for generating secondary electrons, and then for invertedly guiding the secondary electrons to the corresponding anode 103.

SUMMARY OF THE INVENTION

In the above-described photomultiplier tube, however, each electron incident surface 105 is entirely flat. Accordingly, when electrons fall incident on the electron incident surface 105 and secondary electrons are emitted from the surface 105, the direction, in which the secondary electrons are emitted, is widely distributed as indicated by arrows in FIG. 1. Accordingly, even though a part of the secondary electrons will properly reach a desired corresponding anode 103, another remaining part will reach an undesired anode 103 that is located to the left of the desired anode 103. This results in crosstalk in the multi-anode photomultiplier tube.

The present invention is attained in view of the above-described problems. An object of the present invention is therefore to provide an electron multiplier and a photomultiplier tube which can provide signals with suppressed crosstalk.

In order to attain the above and other objects, the present invention provides an electron multiplier, comprising: an electron multiplying portion constructed from a plurality of stages of dynodes laminated one on another, each stage of dynode plate having a plurality of channels each for multiplying incident electrons, the electron multiplying portion multiplying incident electrons in a cascade manner through each of the plurality of channels; an anode unit having a plurality of anodes defining a plurality of electron passage gaps each for transmitting therethrough electrons emitted from a corresponding channel of the electron multiplying portion; and an inverting dynode having a plurality of electron incident portions each for receiving electrons having passed through a corresponding electron passage gap in the anode unit and for guiding the electrons back to the corresponding anode, each of the plurality of electron incident portions including a main surface confronting the corresponding electron passage gap and a rising surface which rises in a direction toward the anode unit from an edge of the main surface which is located at a position confronting the corresponding electron passage gap.

Each of the plurality of electron incident portions may include a main portion having the main surface which confronts the corresponding electron passage gap and a rising portion which rises in a direction toward the anode unit from an edge of the main portion, the edge being located at a position confronting the corresponding electron passage gap, the rising portion having the rising surface which rises from the main surface. The rising surface of each electron incident portion may confront the corresponding anode.

The plurality of anodes may be arranged in a matrix structure. In this case, the inverting dynode may have a separating portion for dividing the plurality of electron incident portions into at least two groups, each electron incident portion further including a separating rising surface which rises in a direction toward the anode unit from an end of the main surface at a position confronting the electron passage gap of the corresponding anode and which connects the main surface to the separating portion.

BRIEF DESCRIPTION OF THE DRAWINGS

The above and other objects, features and advantages of the invention will become more apparent from reading the following description of the preferred embodiment taken in connection with the accompanying drawings in which:

FIGS. 7(*b*) and 7(*c*) are sectional views of further modifications of the electron incident portion;

FIG. 8(*b*) is an enlarged perspective view of a modification of the end portion of the electron incident portion;

DETAILED DESCRIPTION OF THE PREFERRED EMBODIMENTS

Figure 1:
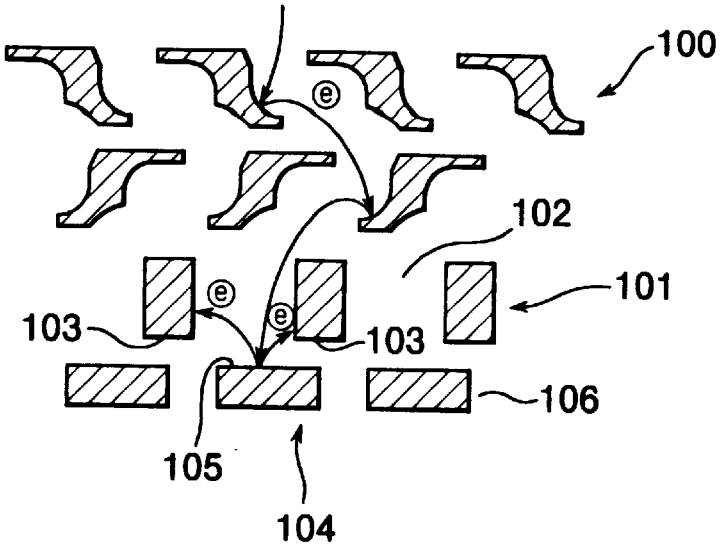
FIG. 1 Prior Art
FIG. 1 is a sectional view of a conventional photomultiplier tube.

A photomultiplier tube according to preferred embodiments of the present invention will be described while referring to the accompanying drawings wherein like parts and components are designated by the same reference numerals.

A first embodiment will be described below with reference to FIGS. 2 through 9.

Directional terms, such as up, down, right, and left will be used in the following description with reference to the state of the photomultiplier tube 1 located in an orientation shown in FIG. 2.

Figure 2:
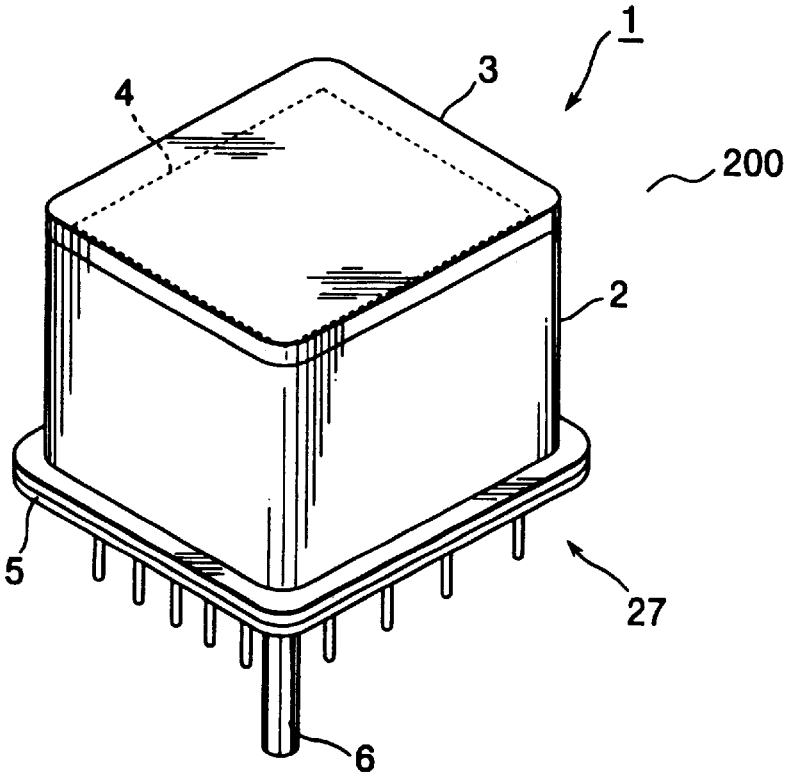
FIG. 2 is an external perspective view of a photomultiplier tube of a first embodiment of the present invention.

FIG. 2 is a perspective external view showing a box-shaped photomultiplier tube 1 of the present embodiment. As apparent from the figure, the photomultiplier tube 1 has an evacuated envelope 200 having a generally square-shaped faceplate 3, a generally cylindrical metal sidewall 2 having a square cross-section, and a generally square-shaped stem 5. The square-shaped faceplate 3 is sealingly attached to one open end (upper open end) of the square-cylindrical sidewall 2. For example, the square-shaped faceplate 3 is airtight welded to the upper open end of the cylindrical sidewall 2. The faceplate 3 is made of glass. A photocathode 4 is formed on the interior surface of the faceplate 3. The photocathode 4 is for converting incident light into photoelectrons. The stem 5 is sealingly attached to the other open end (lower open end) of the cylindrical sidewall 2.

Figure 3:
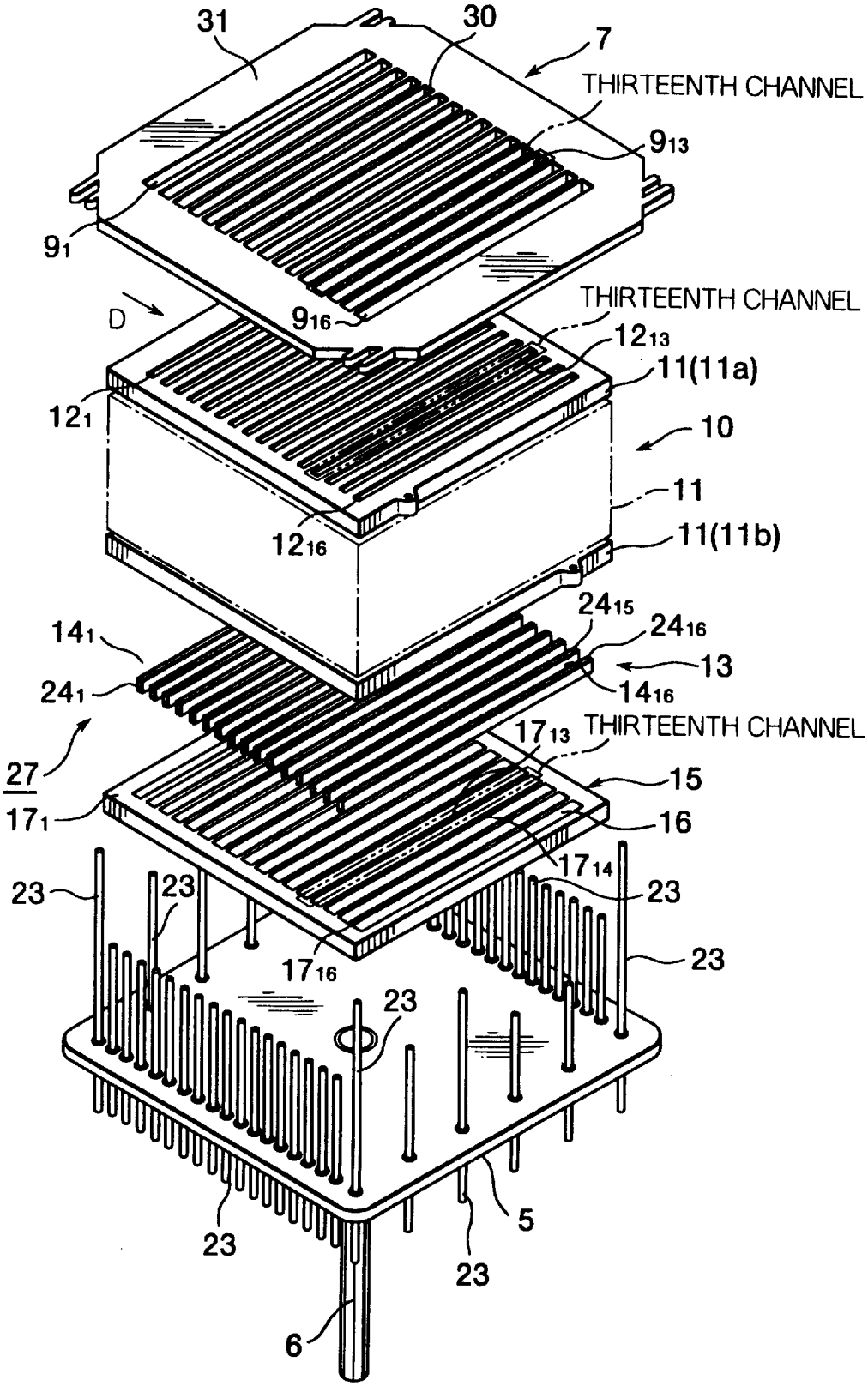
FIG. 3 is an exploded perspective view of an electron multiplier assembly employed in the photomultiplier tube of the first embodiment.

Inside the envelope 200 is provided an electron multiplier assembly 27, shown in FIG. 3, for multiplying photoelectrons emitted from the photocathode 4.

The multiplier assembly 27 includes: a plate-shaped focusing electrode 7; a block-shaped dynode unit 10; an anode unit 13; and an inverting dynode plate 15. The dynode unit 10 is constructed from eight stages of dynode plates 11 which are arranged as stacked one on another. The eight stages of dynode plates include a first stage dynode plate 11*a* which is located at the uppermost position of the dynode unit 10, a second stage dynode plate 11*c* which is located just below the first stage dynode plate 11*a*, and a final stage dynode plate 11*b* which is located at the lowermost position of the dynode unit 10.

The stem 5 is a generally square-shaped metal plate. A metal exhaust tube 6 is provided in the center of the stem 5 to protrude vertically downward as shown in FIG. 3. A plurality of stem pins or stem leads 23 are provided also extending vertically through the stem 5. The focusing electrode 7, the dynode unit 10, the anode unit 13, and the inverting dynode plate 15 are fixed to the stem 5 via the corresponding stem pins 23. The stem pins 23 thus support the focusing electrode 7, the dynode unit 10, the anode unit 13, and the inverting dynode plate 15 in the integral assembly 27. For example, the focusing electrode 7 is supported by four stem pins 23 that are located at the corners of the square stem 5.

The stem pins 23 are also for supplying voltages to the multiplier assembly 27. That is, the stem pins 23 are connected to an electric source (not shown) so that the focusing electrode 7, the dynode unit 10, the anode unit 13, and the inverting dynode plate 15 are supplied with predetermined electric voltages. The focusing electrode 7, the dynode unit 10, the inverting dynode plate 15, and the anode unit 13 are supplied with the predetermined electric voltages so that the focusing electrode 7, the dynode unit 10, the inverting dynode plate 15, and the anode unit 13 have gradually increased potentials in this order. The respective stages of dynode plates 11 in the dynode unit 10 are supplied with predetermined voltages so that the dynodes of the respective stages have gradually increased potentials toward the anode unit 13.

It is noted that the stem 5 and the four pins 23 that support the focusing electrode plate 7 are made to have the same electric potential by the electric source (not shown). When the assembly 27 is mounted in the envelope 200, the stem 5 is electrically connected to the sidewall 2. The sidewall 2 is electrically connected to the photocathode 4. Accordingly, when the assembly 27 is mounted in the envelope 200, the photocathode 4 is electrically connected to the focusing electrode plate 7. Thus, the photocathode 4 and the focusing electrode plate 7 have an equal electric potential.

The multiplier assembly 27 will be described below in greater detail.

Figure 9:
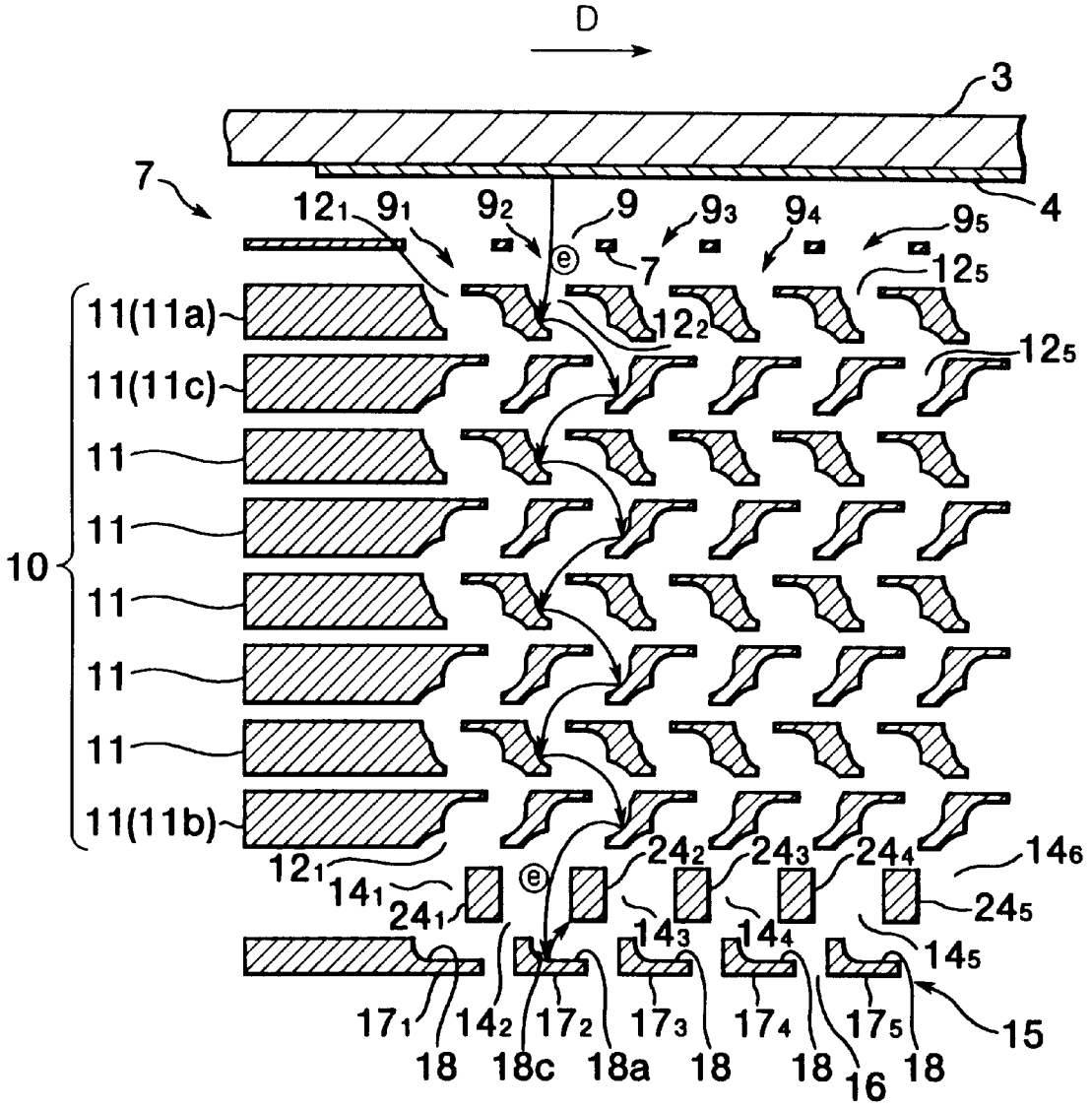
FIG. 9 is a sectional view of a part of the photomultiplier tube.

Each stage dynode plate 11 in the dynode unit 10 is electrically conductive and has upper and lower surfaces. In the plate 11, there are formed a plurality of, sixteen in this example, through-holes 12 by etching or other means. Each through-hole 12 has a long, rectangular cross-section. The through-holes 12 are arranged in a one-dimensional array along a predetermined direction D. In other words, first through sixteenth through-holes $\mathbf{12}_1$ through $\mathbf{12}_{16}$ are arranged in the direction D. The inner surface of each through-hole 12 is curved and tapered as shown in FIG. 9. Thus, the inner surface of the through-hole 12 is slant relative to an incidence direction of electrons entering the through-hole 12 from the photocathode 4. The curved and slant inner surface of the through-hole 12 is formed with a secondary electron emitting layer made of secondary electron emitting substance such as antimony (Sb) and alkali metal. When electrons entering the through-hole 12 impinge on the inner surface of the through-hole 12, secondary electrons are emitted from the inner surface.

In the dynode unit 10, as shown in FIG. 9, each dynode plate 11 is laid on its adjacent lower dynode plate 11 in such a manner that secondary electrons emitted from the slanted inner surface of each through-holes 12*i* at each dynode plate 11 will properly enter a corresponding through-hole 12*i* at the corresponding adjacent lower dynode plate 11 where $1 \leqq i \leqq 16$. Thus, each through-hole 12*i* at each dynode plate 11 is located at a position where secondary electrons, emitted from the corresponding through-hole 12*i* at the upper adjacent stage dynode plate 11, can reach.

With the above-described structure of the dynode unit 10, sixteen channels (first through sixteenth channels) are created by the sixteen through-holes $\mathbf{12}_1$ through $\mathbf{12}_{16}$ in the successively-stacked dynode plates 11. Incident electrons can be multiplied through each of the sixteen channels. That is, when electrons are incident on the first stage dynode plate 11*a* at one through-hole 12*i* ($1 \leqq i \leqq 16$), the electrons impinge on the slantedly-curved inner surface of the through-hole 12*i*. Secondary electrons are emitted from the secondary electron emitting layer on the slanted surface. The secondary electrons are then guided by an electric field formed by a potential difference between the first stage dynode plate 11*a* and the second stage dynode plate 11*c,* and fall incident on the second stage dynode plate 11*c* and multiplied there again in the same way. Thus, the flow of incident electrons are multiplied by secondary electron emission through each of the sixteen channels.

The structure of the through-holes 12 in each dynode plate 11 is disclosed in U.S. Pat. No. 5,410,211, the disclosure of which is hereby incorporated by reference.

The focusing electrode plate 7 is located above the dynode unit 10 and just below the photocathode 4. The focusing electrode plate 7 is formed with sixteen slit openings 9 which are arranged in a one-dimensional array along the direction D. That is, first through sixteenth openings $\mathbf{9}_1$ through $\mathbf{9}_{16}$ are arranged in the direction D. The sixteen slit openings are separated from one another by fifteen electrode strips 30. The electrode strips 30 are supported to a frame portion 31 of the focusing electrode plate 7. Each slit opening 9*i* is located in confrontation with a corresponding through-hole 12*i* of the dynode unit 10 where $1 \leqq i \leqq 16$. Each slit opening 9*i* defines a channel (i-th channel) for guiding photoelectrons to the corresponding channel 12*i* where $1 \leqq i \leqq 16$. The focusing electrode plate 7 establishes an electron lens effect in each slit opening 9*i* due to an electric potential induced to the frame portion 31 and the electrode strips 30. Each slit opening 9*i* therefore serves to electrically guide electrons, that are incident on the subject slit opening 9*i,* into a corresponding through-hole 12*i* of the first stage dynode plate 11. Thus, each channel 9*i* serves to guide photoelectrons from the photocathode 4 to a corresponding channel 12*i* of the dynode unit 10.

Figure 5:
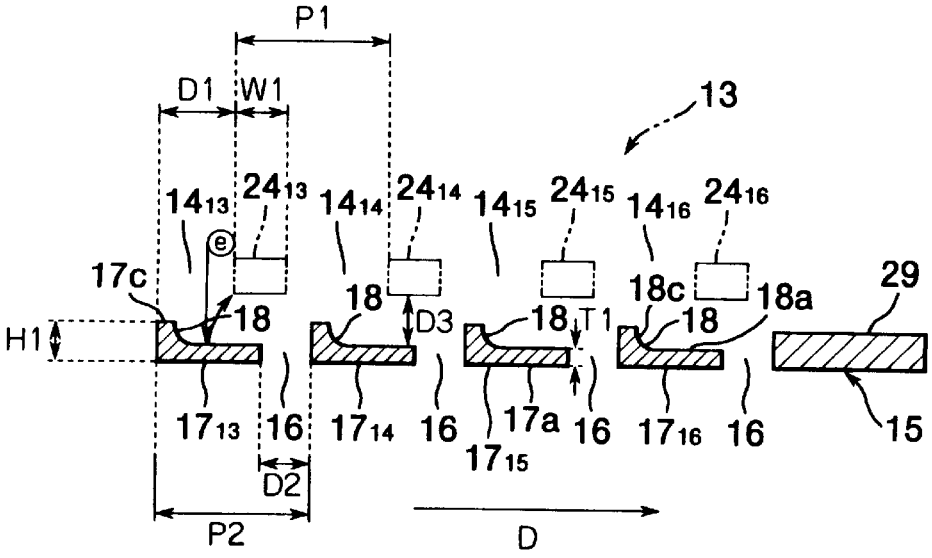
FIG. 5 is a sectional view taken along a line V—V of FIG. 4.

The anode unit 13 and the inverting dynode plate 15 are disposed in this order beneath the final (eighth) stage dynode plate 11*b* of the dynode unit 10. The anode unit 13 is constructed from sixteen elongated anode strips 24, which are electrically insulated from one another. The anodes 24 are arranged in a one-dimensional array along the direction D. That is, first through sixteenth anodes 24, through $\mathbf{24}_{16}$ are arranged in the direction D. In the anode unit 13, sixteen electron passage gaps 14 (first through sixteenth gaps $\mathbf{14}_1$, through $\mathbf{14}_{16}$) are defined. In FIGS. 5 and 9, each gap 14*i* is defined as located to the left of a corresponding anode 24*i* where $1 \leqq i \leqq 16$. Each anode 24*i* is located as shown in FIG. 9 so that its corresponding electron passage gap 14*i* is located at a position where secondary electrons, emitted from a corresponding through-hole 12*i* at the final (eighth) stage dynode plate 11*b,* reach.

Figure 4:
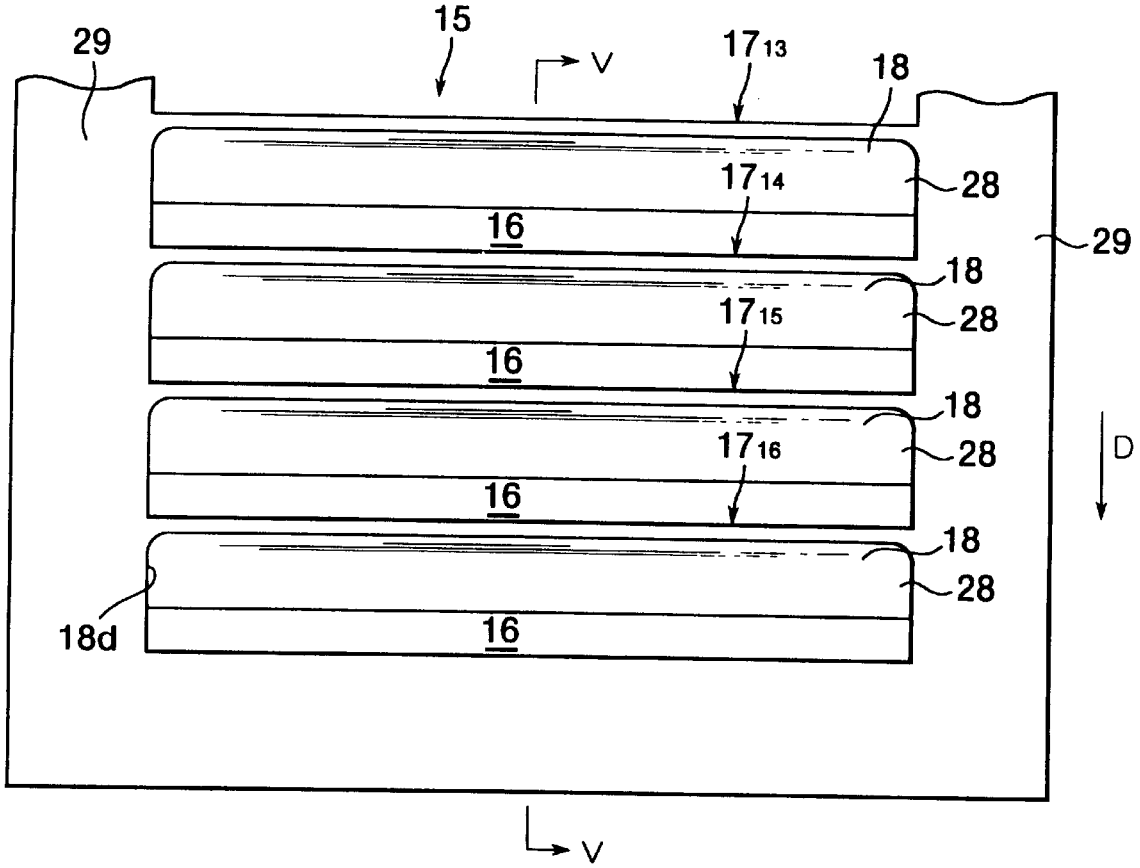
FIG. 4 is a plan view of a part of an inverting dynode plate.

As shown in FIGS. 3, 4, and 5, the inverting dynode plate 15 is located below the anode unit 13. The inverting dynode plate 15 is for inverting the orbits of the secondary electrons, which have passed through the gaps 14 in the anode unit 13, in a direction back to the anode unit 13. The inverting dynode plate 15 is formed with sixteen electron incident strips 17 (first through sixteenth strips $\mathbf{17}_1$, through $\mathbf{17}_{16}$) which are arranged in a one-dimensional array in the direction D. Each electron incident strip 17*i* constitutes an i-th channel and is located in confrontation with the corresponding electron passage gap 14*i* ($1 \leqq i \leqq 16$). That is, each electron incident strip 17*i* is located at a position where secondary electrons having passed through the corresponding electron passage 14*i* reach.

As shown in FIG. 9, each electron incident strip 17*i* is for receiving electrons having passed through the gap 14*i* that confronts the subject strip 17*i*. The electron incident strip 17*i* then emits secondary electrons and guides the electrons toward an anode 24*i* of the same (i-th) channel, where $1 \leqq i \leqq 16$. Thus, each strip 17*i* is for inverting the orbits of the electrons having passed through the confronting gap 14*i* and for guiding the electrons to the corresponding anode 24*i*. It is noted that a slit-shaped through-hole 16 is formed between each pair of adjacent electron incident strips 17. The slit-shaped through-holes 16 are for guiding alkali metal vapor introduced from the tube 6 into the inside of the envelope 200 during the manufacturing process as will be described later.

As shown in FIG. 5, each electron incident strip 17*i* is formed with an electron incident surface 18 on its upper surface. The electron incident surface 18 of each electron incident strip 17*i* is located to receive electrons having passed through the corresponding electron passage gap 14*i*.

Figure 6:
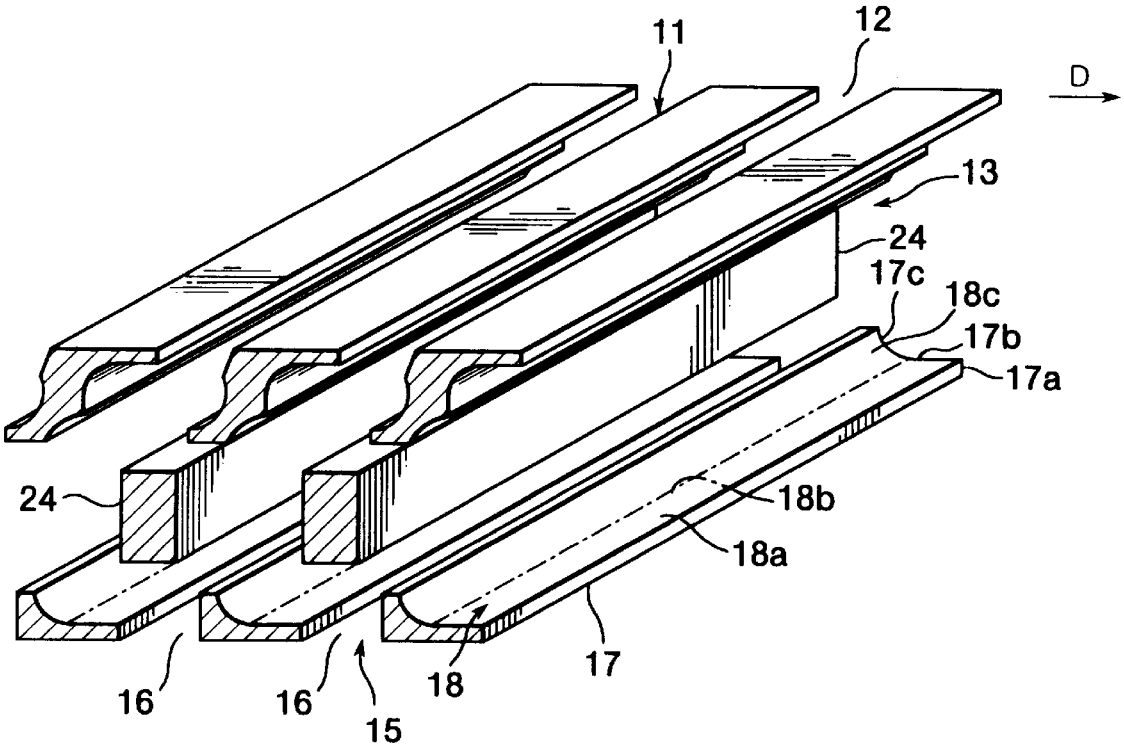
FIG. 6 is a perspective view showing the relationship between a final stage dynode, an anode unit, and the inverting dynode plate.

As shown in FIG. 6, the electron incident surface 18 of each strip 17 (17*i*) is constructed from a main flat surface 18*a* and a rising surface 18*c*. The rising surface 18*c* rises or extends upwardly, from an edge 18*b* of the flat surface 18*a,* in a direction toward the anode unit 13. More specifically, each strip 17*i* is constructed from a main flat plate portion 17*a* and a projection wall portion 17*c* which projects upwardly from a leftside edge 17*b* of the main flat plate portion 17*a* in FIG. 6. The flat plate portion 17*a* has the main flat surface 18*a* as its upper surface. The projection wall portion 17*c* has the rising surface 18*c* as its surface that faces rightwardly. The main flat surface 18*a* and the rising surface 18*c* of each electron incident strip 17*i* therefore confronts the corresponding anode 24*i* that is located in an upper-rightside position of the subject strip 17*i* as shown in FIG. 5.

For example, when the anodes 24, each of which has a width W1 of 0.34 mm, are arranged at a pitch P1 of 1.0 mm in the direction D, the electron incident portions 17 are arranged at a pitch P2 of 1.0 mm. A distance D2 between each two adjacent incident portions 17 is set to 0.3 mm. A horizontal shift distance D1 between the anodes 24 and the corresponding electron incident portions 17 is set to 0.515 mm. A vertical shift distance D3 between the anodes 24 and the electron incident portions 17 is set to 0.367 mm. In this case, the thickness T1 of the main flat plate portion 17*a* of each electron incident portion 17 is set to 0.083 mm, and the height H1 of the projection wall portion 17*c* is set to 0.25 mm. An electric potential difference between the anodes 24 and the electron incident portions 17 is set to 64 volts, for example. That is, a difference (V24–V17) between an electric potential V24 of the anodes 24 and an electric potential V17 of the electron incident portions 17 is set to 64 volts. A difference (V17–V11*b*) between the electric potential V17 and an electric potential V11*b* of the final stage dynode plate 11*b* is set to 64 volts. A difference (V24–V11*b*) between the electric potential V24 and the electric potential V11*b* is set to 128 volts.

The rising surface 18*c* is preferably curved with respect to the flat surface 18*a* as shown in FIGS. 5 and 6. When the rising surface 18*c* is thus curved, equipotential surfaces having the same curved shape as the rising surface 18*c* are developed in a space between the rising surface 18*c* of each strip 17*i* and the corresponding anode 24*i*. The thus established equipotential surfaces therefore increase the number of secondary electrons to be properly picked up by the anode 24 of the same channel. The electron incident surface 18 having the above-described shape is formed through an etching operation or the like. The electron incident surface 18 is coated with secondary electron emission substance such as antimony and alkali metal. Upon receipt of electrons, therefore, the electron incident surface 18 emits secondary electrons.

Figure 7A:
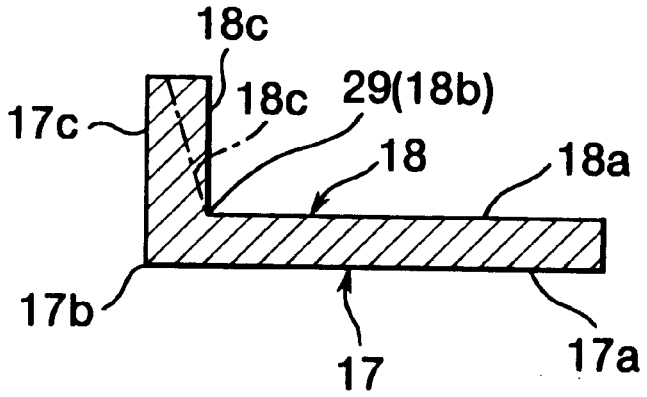
FIG. 7(*a*) is a sectional view of each electron incident portion of the inverting dynode plate according to modifications.
Figure 7B:
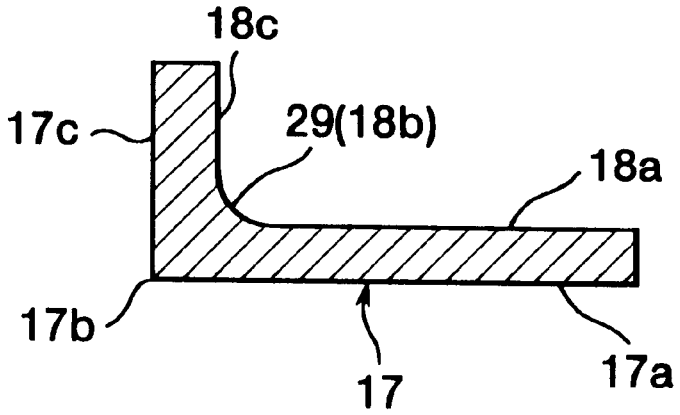
Figure 7C:
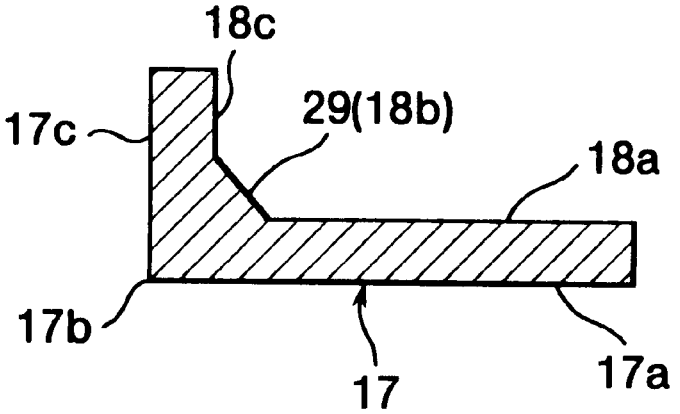

As indicated by solid line in FIG. 7(*a*), the corner 29 at the edge 18*b* between the surfaces 18*a* and 18*c* may be right angled. That is, the surface 18*c* may not be curved, but may be planar, and may extend perpendicularly with respect to the surface 18*a*. Or, the rising surface 18*c* may be slanted with respect to the main flat surface 18*a* as indicated by one-dot-and-one-chain line in that figure. Only the corner 29 at the edge 18*b* between the surfaces 18*a* and 18*c* may be designed as curved as shown in FIG. 7(*b*) or slanted as shown in FIG. 7(*c*). In all these cases, both the surfaces 18*a* and 18*b* can properly confront the corresponding anode 24.

Figure 8A:
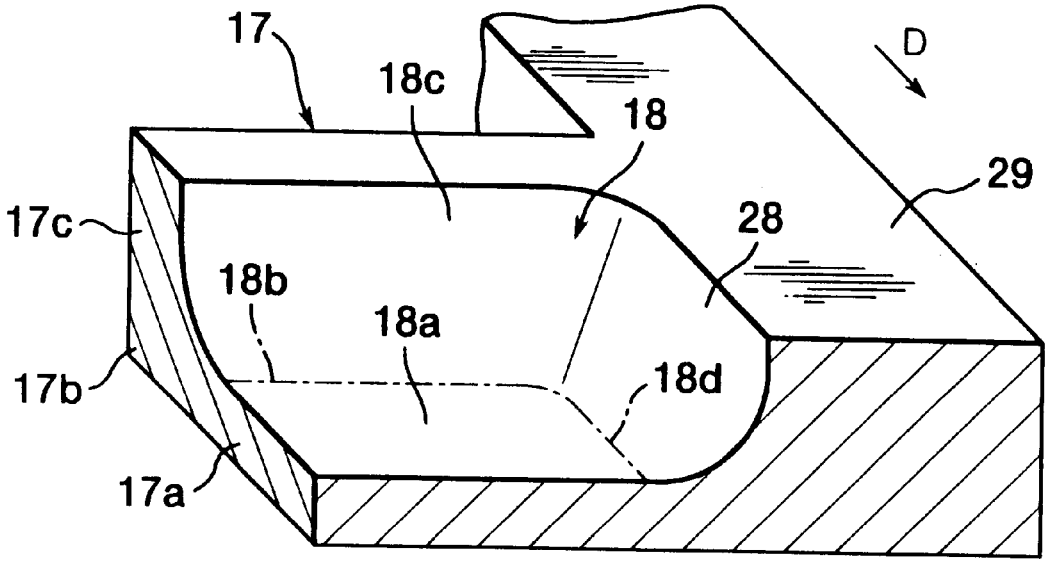
FIG. 8(*a*) is an enlarged perspective view of an end portion of the electron incident portion.
Figure 8B:
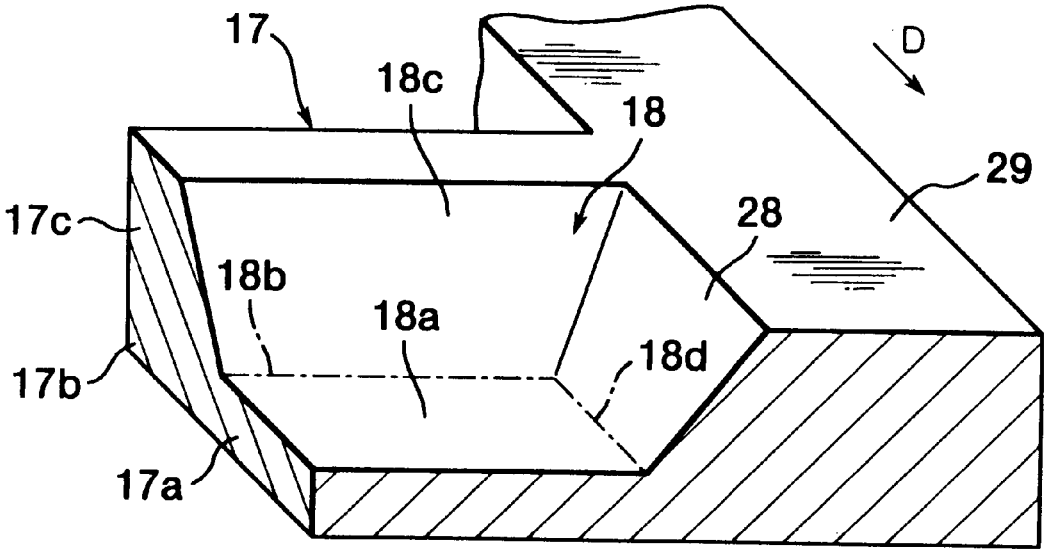

As shown in FIGS. 4 and 8(*a*), the inverting dynode plate 15 further has a frame portion 29 which supports the plurality of electron incident strips 17. Each electron incident portion 17 is connected to the frame 29 via its opposite side walls 28. The opposite side walls 28 are formed at opposite ends 18*d* of each electron incident strip 17 along its longitudinal direction, i.e., along a direction orthogonal to the direction D. Each side wall 28 rises, from the corresponding end portion 18*d* of the main flat surface 18*a,* upwardly in a direction toward the anode unit 13.

Similarly to the rising surface 18*c,* each side wall 28 is curved with respect to the main flat surface 18*a*. However, the side wall 28 may not be curved, but may be slanted with respect to the main surface 18*a* as shown in FIG. 8(*b*). Similarly to the rising surface 18*c* shown in FIGS. 7(*a*)–7(*c*), the corner between the rising surface 28 and the main flat surface 18*a* may be right angled. Only the corner between the rising surface 28 and the main flat surface 18*a* may be slanted or curved. In all these cases, the side wall 28 of each electron incident portion 17*i* can confront the corresponding anode 24*i*.

During manufacture of the photomultiplier tube 1 having the above-described structure, the faceplate 3, with its inner surface being vacuum-deposited with antimony (Sb), is first sealingly attached to the upper open end of the square-cylindrical sidewall 2. Then, the electron multiplier assembly 27 is mounted onto the stem 5 via the stem leads 23. An inner surface of each through-hole 12 at each dynode plate 11 is already vacuum deposited with antimony (Sb). The electron incident surface 18 of each electron incident strip 17 is also already vacuum deposited with antimony (Sb). Then, the multiplier assembly 27 mounted with the stem 5 is inserted into the square-cylindrical sidewall 2 through the lower open end. Then, the stem 5 is sealingly attached to the lower open end of the sidewall 2.

The tube 6, connected to the stem 5, is then connected to an exhaust system, such as a vacuum pump (not shown), to provide communication between the interior of the photomultiplier tube 1 and the exhaust system. The exhaust system evacuates the envelope 200 via the tube 6, and then alkali metal vapor is introduced into the envelope 200 through the tube 6. The alkali metal is activated with the antimony on the faceplate 3 to produce the photocathode 4. The alkali metal is activated also with the antimony on the inner surface of each through-hole 12 to produce the secondary electron emitting layer. The alkali metal is activated also with the antimony on the electron incident surface 18 of each electron incident strip 17 to produce the secondary electron emitting layer. The tube 6 is unnecessary after production of the photomultiplier tube 1 is complete, and so is severed at the final stage of producing the photomultiplier tube 1 through a pinch-off seal or the like.

The manufacturing method is described in detail in U.S. Pat. No. 5,504,386, the disclosure of which is hereby incorporated by reference.

The photomultiplier tube 1 having the above-described structure operates as described below.

The focusing electrode plate 7, the dynode unit 10, the anode unit 13, and the inverting dynode plate 15 are supplied with predetermined electric voltages via the pins 23. When light falls incident on the photomultiplier tube 1 from outside of the envelope 200, the light is converted into photoelectrons at the photocathode 4. As indicated by an arrow in FIG. 9, the photoelectrons convergently pass through one opening 9*i* (i-th channel; $1 \leqq i \leqq 16$) of the focusing electrode plate 7 before entering the i-th through-hole 12*i* of the dynode plate 11. The photoelectrons are multiplied in a cascade manner in the multistage of the dynode plates 11 along the i-th channel, and are outputted from the dynode unit 10. The photoelectrons then pass through the i-th electron passage gap 14*i,* and fall incident on the i-th electron incident strip 17*i* of the inverting dynode plate 15. Secondary electrons are then generated at the electron incident strip 17*i,* and are attracted to the i-th anode 24*i*.

As shown in FIGS. 5 and 6, each electron incident strip 17*i* has the rising surface 18*c* and the main flat surface 18*a,* both of which confront the anode 24*i* of the same channel. The equipotential surfaces formed between the electron incident strip 17*i* and the corresponding anode 24*i* can guide the secondary electrons, generated at the strip 17*i,* in a direction orthogonal to the equipotential surfaces, i.e., in a direction toward the anode 24*i*. Accordingly, the secondary electrons emitted from the strip 17*i* will reach the anode 24*i* of the same channel, but will not stray to other anodes 24. Thus, the anodes 24 can be used in one to one correspondence with the electron incident strips 17 of the inverting dynode plate 15. It is possible to suppress the crosstalk generation between the adjacent anodes 24.

Thus, position-dependent light intensity detection can be performed by the sixteen anodes 24 with high accuracy. That is, the photomultiplier tube 1 can detect the position where light is incident on the faceplate 3 by determining which leads 23 from the anodes 24 produce the greatest current. Because the current from the leads 23 varies dependent on the amount of incident light, the leads 23 which output the greatest current will be those directly beneath the position where light is incident on the photomultiplier tube 1. Because the anodes 24 are arranged in the one dimensional array along the direction D, it is possible to detect the light incident position one-dimensionally along the direction D.

As described above, according to the first embodiment, the dynode unit 10 is constructed from the plurality of stages of dynodes 11 laminated one on another for multiplying incident electrons in a cascade manner through each of the plurality of channels. The anode unit 13 has the plurality of anodes 24 which define the plurality of electron passage gaps 14 each for transmitting therethrough electrons emitted from the dynode unit 10 at a corresponding channel. The inverting dynode plate 15 is provided with the plurality of electron incident strips 17 each for receiving electrons having passed through the corresponding electron passage gap 14 in the anode unit 13, multiplying the electrons, and guiding the electrons back to the corresponding anode 24. Each electron incident strip 17 is designed to have: the main surface 18*a* confronting the electron passage gap 14; and the rising surface 18*c* rising toward the anode unit 13 from the edge 18*b* of the main surface 18*a* which is located at a position confronting the electron passage gap 14 in the anode unit 13. Both of the main surface 18*a* and the rising surface 18*c* of each electron incident strip 17 face in a direction toward a corresponding anode.

A second embodiment will be described below with reference to FIGS. 10 through 15. The components in the present embodiment the same as or similar to those in the first embodiment are indicated by the same reference numerals.

Figure 10:
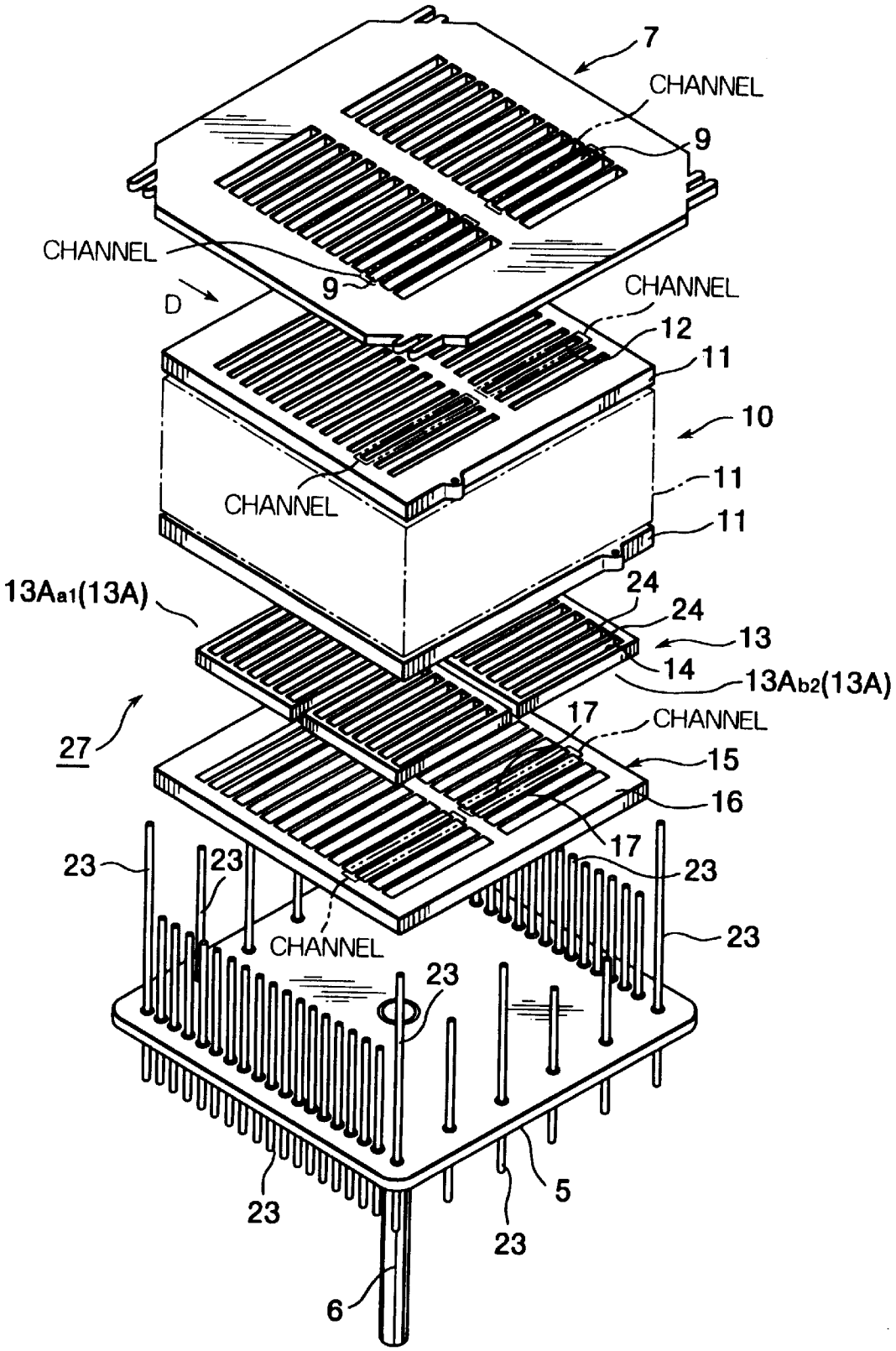
FIG. 10 is an exploded perspective view of an electron multiplier assembly employed in a photomultiplier tube of a second embodiment.

A photomultiplier tube 1 of the present embodiment is the same as that of the first embodiment except that the photomultiplier tube 1 of the present embodiment is provided with an electron multiplier assembly 27 shown in FIG. 10. In this multiplier assembly 27, the anode unit 13 includes four anodes 13A which are arranged in a matrix form. This photomultiplier tube can therefore detect light incident position two-dimensionally.

The electron multiplier 27 of the present embodiment will be described below in greater detail.

Figure 11:
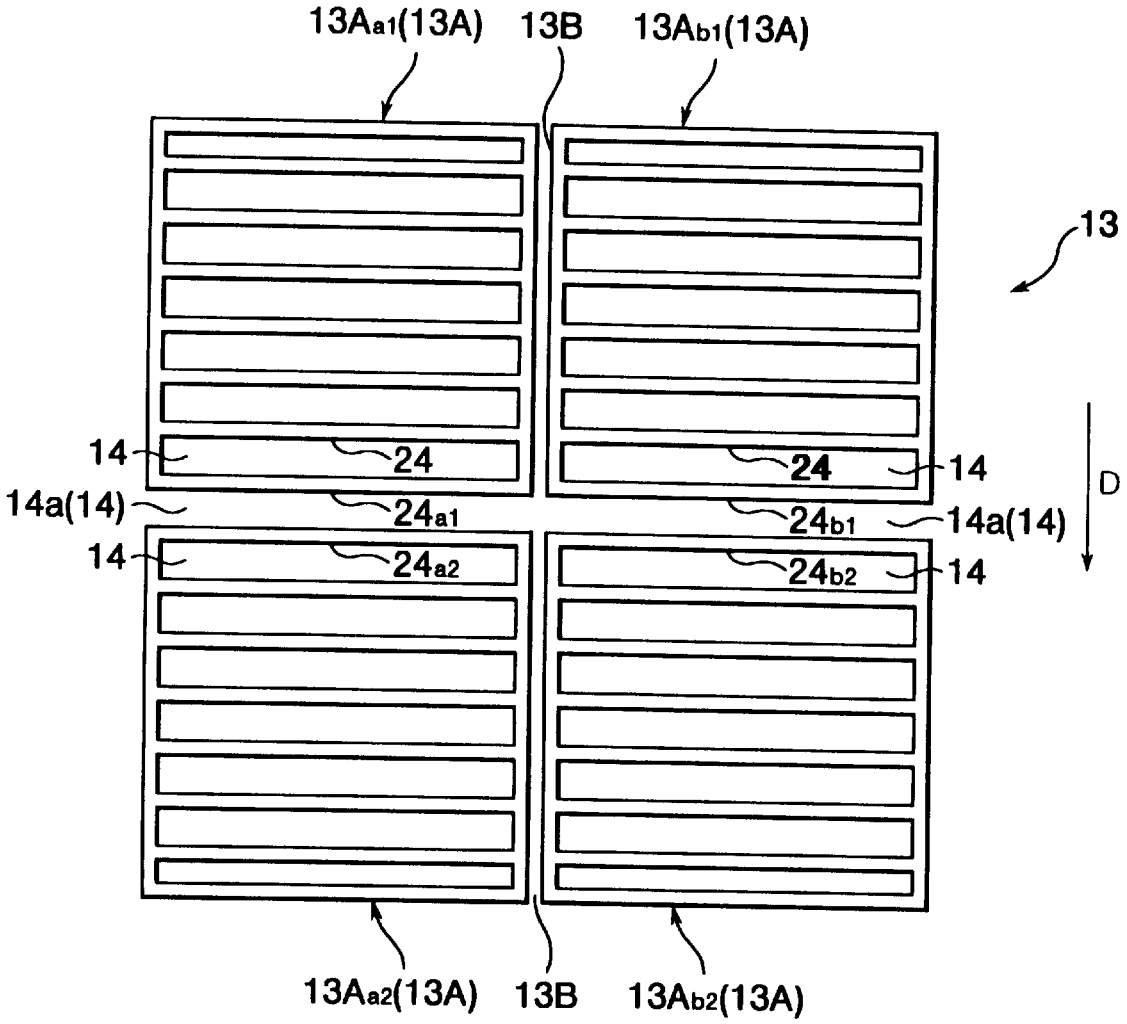
FIG. 11 is a plan view of an anode unit used in the photomultiplier tube of the second embodiment.

As shown in FIG. 11, the anode unit 13 of the present embodiment is constructed from four anodes 13A (13Aa1, 13Aa2, 13Ab1, and 13Ab2) which are arranged in a two-dimensional matrix form. That is, the four anodes 13Aa1, 13Aa2, 13Ab1, and 13Ab2 are arranged in a two by two matrix form and are electrically insulated from one another. Each of the anodes 13A is formed with a plurality of (seven, for example) electron passage through-holes 14. The electron passages 14 are arranged in a one-dimensional array in the predetermined direction D in each anode 13A. In other words, each anode 13A has a plurality of anode strips 24 which are separated from one another by the passages 14. Each strip 24 is elongated in a direction orthogonal to the direction D.

The four anodes 13Aa1, 13Aa2, 13Ab1, and 13Ab2 are electrically insulated from one another. That is, the anodes 13Aa1 and 13Ab1 are spaced from each other with a gap 13B therebetween. The anodes 13Aa2 and 13Ab2 are also spaced from each other with the gap 13B therebetween. A gap 14*a* is formed between the adjacent anodes 13Aa1 and 13Aa2 and between the adjacent anodes 13Ab1 and 13Ab2. The gap 14*a* serves as an additional electron passage 14 which is located between an edge anode strip 24*a*1 of the anode 13Aa1 and an edge anode strip 24*a*2 of the anode 13Aa2. The gap 14*a* also serves as an additional electron passage 14 which is located between an edge anode strip 24*b*1 of the anode 13Ab1 and an edge anode strip 24*b*2 of the anode 13Ab2.

Figure 12:
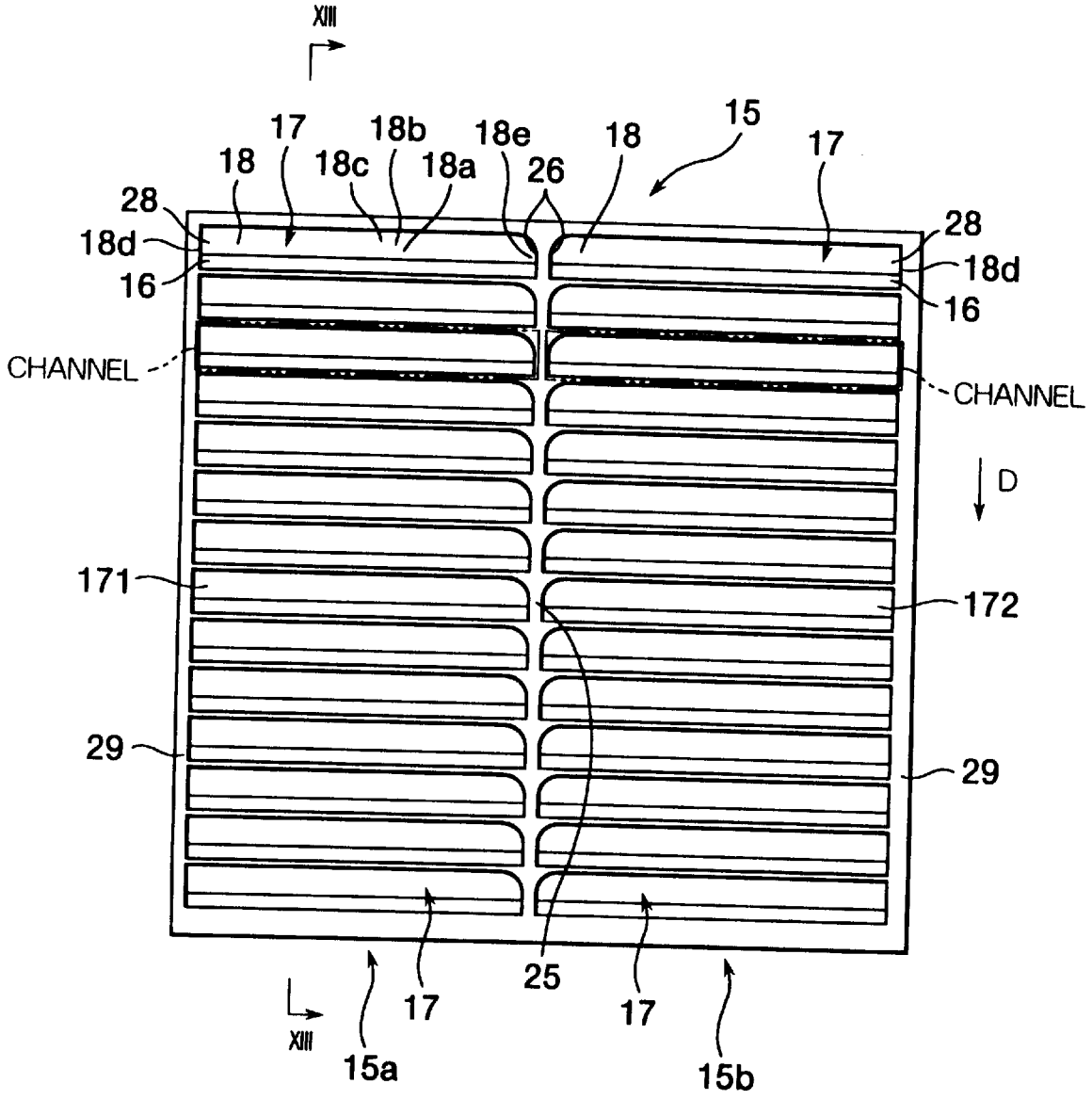
FIG. 12 is a plan view of an inverting dynode plate used in the photomultiplier tube of the second embodiment.

The inverting dynode plate 15 employed in the present embodiment is shown in FIG. 12. The inverting dynode plate 15 has not only the frame portion 29 but also a spine portion 25. The spine 25 is in a line shape extending in the direction D and is located in confrontation with the linear gap 13B of the anode unit 13 (shown in FIG. 11). The spine 25 divides the dynode plate 15 into two regions 15*a* and 15*b*. Each of the regions 15*a* and 15*b* has a plurality of electron incident strips 17 which are arranged in a one-dimensional array along the direction D. Each electron incident strip 17 is elongated in a direction orthogonal to the direction D, and is located in confrontation with a corresponding electron passage 14 of the anode unit 13. Each two adjacent electron incident strips 17, arranged in the direction D, are separated from one another with a through-hole 16 therebetween.

Figure 13:
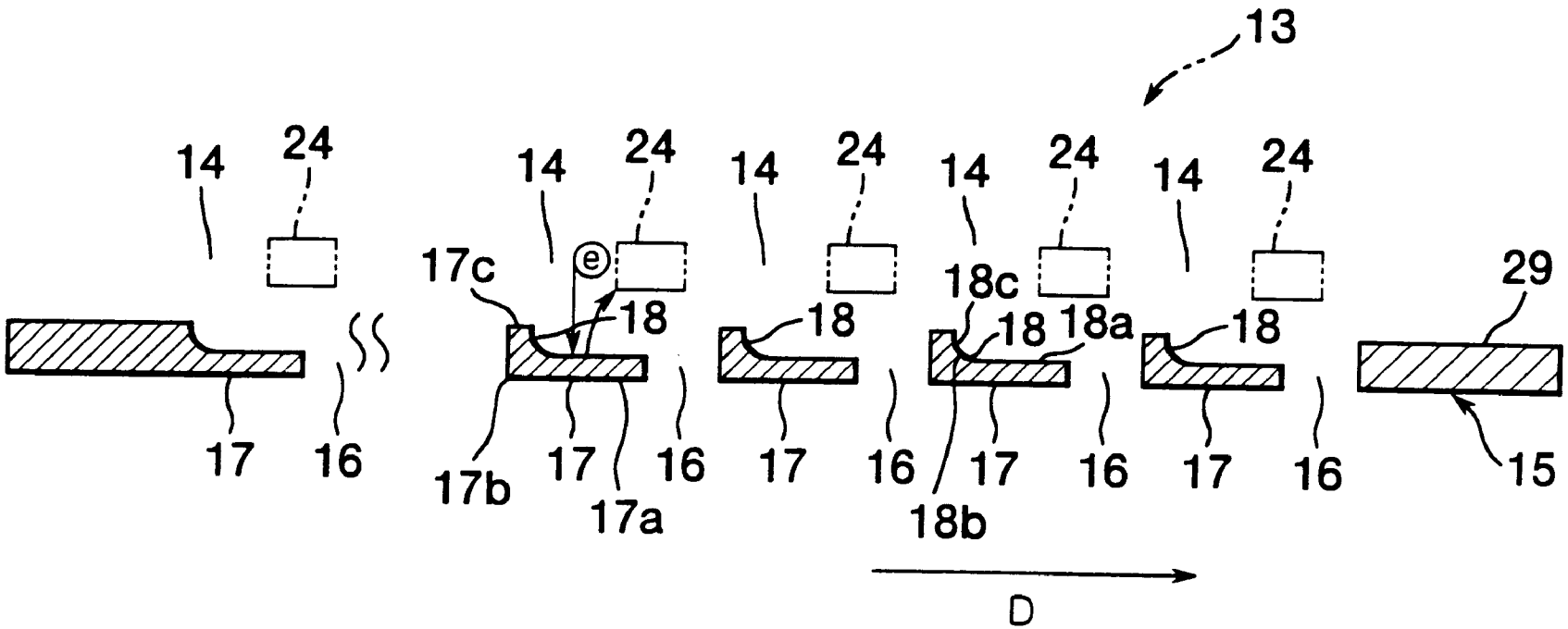
FIG. 13 is a sectional view taken along a line XIII—XIII of FIG. 12.
Figure 14:
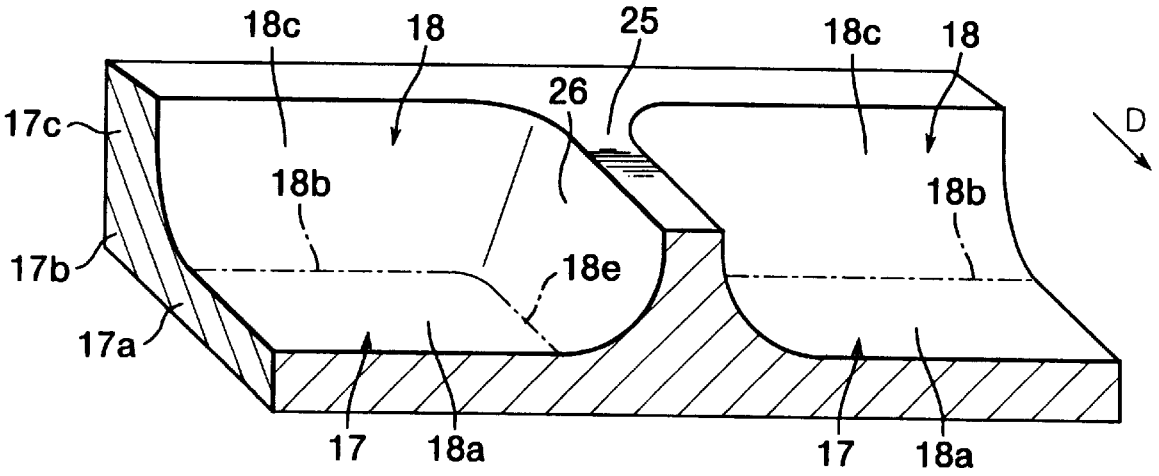
FIG. 14 is a perspective view of an essential portion of the inverting dynode plate of FIG. 12.

As shown in FIGS. 12 through 14, each electron incident strip 17 has an electron incident surface 18 on its upper surface. Similarly to the first embodiment, the electron incident surface 18 is formed with a secondary electron emitting layer. The electron incident surface 18 of each electron incident strip 17 includes a main flat surface 18*a* and a rising surface 18*c*. The rising surface 18*c* rises or extends upwardly toward the anode unit 13 from an edge 18*b* of the main surface 18*a*. The edge 18*b* is defined as an edge of the surface 18*a* along its widthwise direction, i.e., along the direction D. In other words, the electron incident strip 17 has a main flat portion 17*a* and a protrusion wall portion 17*c* protruding upwardly from a leftside edge 17*b* of the main flat portion 17*a* in FIG. 13. The flat portion 17*a* has the main flat surface 18*a* as its upper surface, and the protrusion wall portion 17*c* has the rising surface 18*c* as its surface facing rightwardly. Both of the surfaces 18*a* and 18*c* of each electron incident strip 17 thus confront a corresponding anode strip 24.

With this structure, in each of the regions 15*a* and 15*b*, the plurality of electron incident portions 17 are located relative to the passages 14 and the anode strips 24 as shown in FIG. 13 in the same manner as in the first embodiment. That is, each electrode strip 17 is located for receiving electrons that have passed through its confronting through-hole 14, for emitting secondary electrons, and for properly guiding the secondary electrons to a corresponding anode strip 24 that is located just to the right of the corresponding through-hole 14. It is therefore possible to suppress crosstalk between each pair of adjacent anode strips 24 arranged in the direction D.

According to the present embodiment, as shown in FIG. 14, the electron incident surface 18 of each electron incident portion 17 further includes another rising surface 26. The rising surface 26 rises or extends upwardly from another edge 18*e* of the main surface 18*a*, the edge 18*e* being defined as an edge of the surface 18*a* along its longitudinal direction, i.e., along a direction orthogonal to the direction D. The rising surface 26 of each strip 17 therefore confronts the corresponding anode strip 24. The rising surface 26 is connected to the spine 25. The rising surface 26 is curved with respect to the main flat surface 18*a*.

Thus, the spine 25 is connected to the main surface 18*a* of each electron incident surface 17 via the curved rising surface 26. Accordingly, it is possible to suppress crosstalk between each pair of electron incident strips 17 and 17 which are arranged adjacent to each other with the spine 25 being sandwiched therebetween. That is, it is possible to suppress crosstalk between the anodes 13Aa1 and 13Ab1 and between the anodes 13Aa2 and 13Ab2.

It is noted that the rising surface 26 may not be curved, but may be slanted relative to the main surface 18*a* in the same manner as the rising surface 18*c* shown in FIG. 7(*a*). The corner between the main surface 18*a* and the rising surface 26 may be right angled as shown in FIG. 7(*a*). Only the corner between the main surface 18*a* and the rising surface 26 may be curved or slanted as shown in FIGS. 7(*b*) and 7(*c*).

As shown in FIG. 12, the inverting dynode plate 15 further has a rising wall 28 which rises upwardly from an edge 18*d* of the main flat surface 18*a*, of each electron incident portion 17, to the frame portion 29 in the same manner as in the first embodiment.

It is noted that according to the present embodiment, it is sufficient to prevent crosstalk between the four anodes 13A from one another. The rising surfaces 26 rising from the main flat surfaces 18*a* to the central frame 25 can prevent crosstalk between the anodes 13Aa1 and 13Ab1 and between the anodes 13Aa2 and 13Ab2. In order to prevent crosstalk between the anodes 13Aa1 and 13Aa2 and between the anodes 13Ab1 and 13Ab2, on the other hand, it is sufficient to provide the rising walls 18*c* only to two electron incident strips 171 and 172 shown in FIG. 12 that are arranged to guide electrons to the two anode strips 24*a*2 and 24*b*2 shown in FIG. 11 that are located in the edges of the anodes 13Aa2 and 13Ab2.

It is noted that as shown in FIG. 10, the focusing electrode plate 7 is designed to have a spine for dividing the electrode plate 7 into two regions in the same manner as the inverting dynode plate 15. Each region has a plurality of (fourteen, in this example) slit-shaped openings 9 which are arranged in a one-dimensional array along the predetermined direction D.

The block-shaped dynode unit 10 is located below the focusing electrode plate 7. Each of the plurality of dynode plates 11, constituting the dynode unit 10, has a plurality of slit-shaped through-holes 12 in correspondence with the plurality of electron incident strips 17 in the inverting dynode plate 15. Thus, each dynode plate is formed with a plurality of (28, in this example) channels which are arranged in a matrix shape as shown in FIG. 10.

While the invention has been described in detail with reference to the specific embodiments thereof, it would be apparent to those skilled in the art that various changes and modifications may be made therein without departing from the spirit of the invention.

Figure 15:
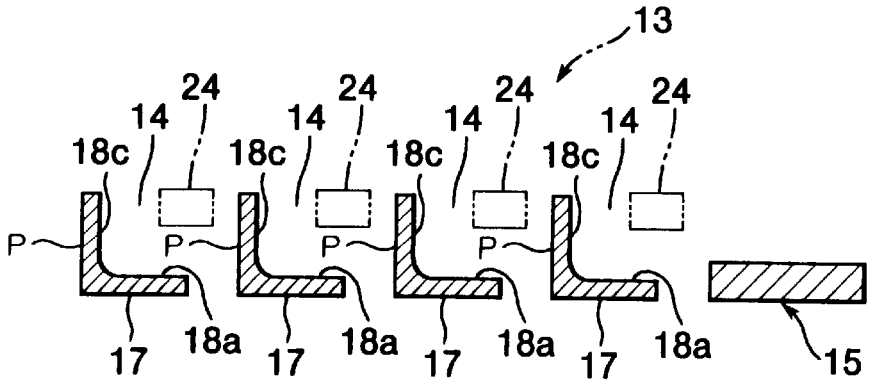
FIG. 15 is a sectional view of a modification of the inverting dynode plate.

For example, as shown in FIG. 15, a relatively thick dynode plate is used as the inverting dynode plate 15. The thick dynode plate is deeply cut to form the plurality of electron incident strips 17. Each strip 17 therefore has the main surface 18*a* and a relatively long protruding portion P having the rising surface 18*c* thereon. The dynode plate 15 is positioned relative to the anode unit 13 so that the protruding portion P of each electron incident strip 17 enters a corresponding electron passage 14. In this case, it is possible to completely separate the pair of adjacent anodes 24 from each other. One-to-one correspondence between the electron incident strips 17 and the anodes 24 can thus be assured. It is possible to further suppress the crosstalk between the respective anodes.

The electron multiplier assembly 27 can be used as an electron multiplier when the electron multiplier assembly 27 is not mounted in the envelope 200, but is used in a vacuum chamber although not shown in the drawings.

As described above, according to the photomultiplier tube of the present invention, when electrons fall incident on a certain channel of the dynode unit, electrons are multiplied in a cascade manner through that channel in the multistage dynodes, and pass through the electron passage gap in the anode unit of the then fall in. The electrons then fall incident on the subject channel of the inverting dynode, whereupon the inverting dynode emits secondary electrons.

According to the present invention, at each channel, the electron incident portion of the inverting dynode plate is designed to have: the main surface confronting the electron passage gap formed through the anode unit; and the rising surface rising toward the anode unit from the edge of the main surface at a position confronting the electron passage gap. With this structure, both of the main surface and the rising surface of the electron incident portion face toward the anode of the same channel. Accordingly, equipotential surfaces, established between each electron incident portion and a corresponding anode, can properly guide the secondary electrons from the electron incident portion in a direction orthogonal to the equipotential surfaces, that is, in a direction toward the anode. Accordingly, one-to-one correspondence between the anodes and the electron incident portions can be reliably established. Crosstalk between adjacent anodes can be greatly suppressed.

What is claimed is:

1. An electron multiplier, comprising:

an electron multiplying portion constructed from a plurality of stages of dynodes laminated one on another, each stage of dynode plate having a plurality of channels each for multiplying incident electrons, the electron multiplying portion multiplying incident electrons in a cascade manner through each of the plurality of channels;

an anode unit having a plurality of anodes defining a plurality of electron passage gaps each for transmitting therethrough electrons emitted from a corresponding channel of the electron multiplying portion; and an inverting dynode having a plurality of electron incident portions each for receiving electrons having passed through a corresponding electron passage gap in the anode unit and for guiding the electrons back to the corresponding anode, each of the plurality of electron incident portions including a main surface confronting the corresponding electron passage gap and a rising surface which rises in a direction toward the anode unit from an edge of the main surface which is located at a position confronting the corresponding electron passage gap.

2. An electron multiplier as claimed in claim 1, wherein each of the plurality of electron incident portions includes a main portion having the main surface which confronts the corresponding electron passage gap and a rising portion which rises in a direction toward the anode unit from an edge of the main portion, the edge being located at a position confronting the corresponding electron passage gap, the rising portion having the rising surface which rises from the main surface.

3. An electron multiplier as claimed in claim 2, wherein the rising surface of each electron incident portion confronts the corresponding anode.

4. An electron multiplier as claimed in claim 3, wherein the main surface is flat, and the rising surface is curved relative to the main surface.

5. An electron multiplier as claimed in claim 3, wherein the main surface is flat, and the rising surface is slanted relative to the main surface.

6. An electron multiplier as claimed in claim 3, wherein the main surface is flat, and a corner defined between the main surface and the rising surface is curved.

7. An electron multiplier as claimed in claim 3, wherein the main surface is flat, and a corner defined between the main surface and the rising surface is right angled.

8. An electron multiplier as claimed in claim 3, wherein the main surface is flat, and a corner defined between the main surface and the rising surface is slanted.

9. An electron multiplier as claimed in claim 3, wherein the plurality of strip-shaped anodes are arranged in one-dimensional array in a single direction.

10. An electron multiplier as claimed in claim 3, wherein the plurality of anodes are arranged in a matrix structure, the inverting dynode having a separating portion for dividing the plurality of electron incident portions into at least two groups, each electron incident portion further including a separating rising surface which rises in a direction toward the anode unit from an end of the main surface at a position confronting the electron passage gap of the corresponding anode and which connects the main surface to the separating portion.

11. An electron multiplier as claimed in claim 10, wherein the main surface is flat, and the separating rising surface is curved relative to the main surface.

12. An electron multiplier as claimed in claim 10, wherein the main surface is flat, and the separating rising surface is slanted relative to the main surface.

13. An electron multiplier as claimed in claim 10, wherein the main surface is flat, and a corner defined between the main surface and the separating rising surface is curved.

14. An electron multiplier as claimed in claim 10, wherein the main surface is flat, and a corner defined between the main surface and the separating rising surface is right angled.

15. An electron multiplier as claimed in claim 10, wherein the main surface is flat, and a corner defined between the main surface and the separating rising surface is slanted.

16. An electron multiplier as claimed in claim 1, further comprising a faceplate formed with a photocathode.

* * * * *